US007015933B2

(12) United States Patent
Han et al.

(10) Patent No.: US 7,015,933 B2
(45) Date of Patent: Mar. 21, 2006

(54) GRAPHIC DATA FILE FOR DISPLAYING GRAPHIC DATA, METHODS FOR GENERATING THE SAME, COMPUTER-READABLE STORAGE MEDIUM AND APPARATUS FOR PLAYING THE SAME

(75) Inventors: Aaron Kwang Ho Han, Palos Verdes Estate, CA (US); Jong-Moon Lee, Kyoungki-do (KR); Kyeong-sang Yeo, Seoul (KR)

(73) Assignee: CAVS Multimedia Inc., (KR)

( * ) Notice: Subject to any disclaimer, the term of this patent is extended or adjusted under 35 U.S.C. 154(b) by 29 days.

(21) Appl. No.: 10/427,285

(22) Filed: May 1, 2003

(65) Prior Publication Data

US 2004/0179809 A1 Sep. 16, 2004

(30) Foreign Application Priority Data

Mar. 14, 2003 (KR) ..... 10-2003-0016147

(51) Int. Cl.
*G09G 5/00* (2006.01)

(52) U.S. Cl. ..... 345/619

(58) Field of Classification Search ..... 345/619; 386/124

See application file for complete search history.

(56) References Cited

U.S. PATENT DOCUMENTS 5,524,202 A * 6/1996 Yokohama ..... 707/104.1
5,561,649 A * 10/1996 Lee et al. ..... 369/47.23

* cited by examiner

*Primary Examiner*—Ryan Yang
(74) *Attorney, Agent, or Firm*—Dinsmore & Shohl LLP

(57) ABSTRACT

A graphic data file containing instructions for displaying graphic data on a display device, the graphic data file having a header identifying the start of the graphic data file, a plurality of portions of instruction data following the header and each portion of instruction data having an instruction for controlling the graphic data of a predetermined size to be displayed and frame information to determine an order and a period of time for displaying the graphic data. A method for generating independent graphic data files including instructions for controlling a process of the graphic data files to be displayed on a display device, and to a corresponding medium and a player. The inventive method comprises the steps of: generating a header containing the information for identifying the start of the graphic data file; generating a plurality of instruction data following the header, each of the instruction data comprising one instruction for controlling the graphic data file of a predetermined size to be displayed on the display device and frame information for determining the order and a period of time of the instruction to be displayed; and generating a tail containing the information for identifying the end of the graphic data file following the plurality of instruction data.

22 Claims, 10 Drawing Sheets

FIG.4

| INSTRUCTION | DEFINED INTEGER | DESCRIPTION |
|---|---|---|
| MEMORY PRESET | 0X0 | PAINT THE ENTIRE SCREEN WITH A GIVEN COLOR |
| BORDER PRESET | 0X1 | SET THE BORDER OF THE SCREEN WITH A GIVEN COLOR |
| COLOR TABLE LOW | 0X2 | LOAD THE EIGHT LOWER ELEMENTS OF THE RGB COLOR TABLE |
| COLOR TABLE HIGH | 0X3 | LOAD THE EIGHT HIGHER ELEMENTS OF THE RGB COLOR TABLE |
| TILE BLOCK NORMAL | 0X4 | DISPLAY THE 2 COLOR BITMAP TILES OF 12X6 BY NORMAL |
| TILE BLOCK XOR | 0X5 | DISPLAY THE 2 COLOR BITMAP TILES OF 12X6 BY XOR |
| SCROLL PRESET | 0X6 | SCROLL THE SCREEN AND PAINT THE EMPTY SPACE WITH A GIVEN COLOR |
| SCROLL COPY | 0X7 | SCROLL THE SCREEN AND PUT THE MOVED IMAGES IN THE EMPTY SPACE |

GRAPHIC DATA FILE FOR DISPLAYING GRAPHIC DATA, METHODS FOR GENERATING THE SAME, COMPUTER-READABLE STORAGE MEDIUM AND APPARATUS FOR PLAYING THE SAME

RELATED APPLICATIONS

This application claims priority to Republic of Korea Patent Application number 10-2003-0016147 filed Mar. 14, 2003.

BACKGROUND OF THE INVENTION

1. Technical field

The present invention relates to a graphic data file permitting its subtitles to be displayed, and more particularly to a method for generating a file in an improved graphic data file format for displaying words together with accompaniment music, that is, karaoke music, used in, e.g., karaoke parlors. The present invention also relates to a medium for storing a graphic data file generated according to the method and an apparatus for playing such file along with an audio and/or video file independent of the file generated according to the invention.

2. Description of the Prior Art

The most popular graphic data file for use in karaoke parlors for displaying words on a screen is in a CD+G file format so that a singer can sing to the accompaniment of a song while the accompaniment music is played. A conventional CD+G (also referred to as CD–G or CD+Graphics) file format is a file format stored on a compact disk medium, called a CD+G disk. In a typical audio CD, approximately 95% of the storage capacity is used as a main channel for storing music data, and the remaining 5% of the storage capacity is used as a subcode channel for storing data such as control data. The CD+G format is used to store graphic data for displaying words in the subcode channel. The subcode channel is not accessible to a common CD player or CD-ROM drive, but accessible only to devices such as some special CD-RW drivers or dedicated CD+G decoders. When a CD+G disk is played in a general audio CD player, only the music stored in the main channel can be played. In order to enjoy karaoke using CD+G disks, an apparatus with a dedicated CD+G player is required.

However, on such one CD+G disk, only ten to twenty songs and their words can be recorded. Therefore, a user has to search for a CD one by one on which the song he wants to play is recorded and place it on the player in order to play the song he wants among tens to hundreds of songs in his CD+G disk collections. The user also has to buy one complete CD+G disk even though he wants to play just a few songs. Accordingly, there has been a need to purchase only the songs for karaoke the user wants through on-line or extract files from his CD+G collections to store them in a system such as a PC to make a database for the files, so that he can easily select a corresponding song to play in necessary case.

Generally, the data for graphic display stored in a subcode channel of the CD+G disk is stored in a CD+G graphic data format. FIGS. 1 and 2 show schematically the data storage structure and a graphic data format of a conventional CD+G disk. With reference to FIG. 1, a CD (10) such as an audio CD or CD+G, CD-ROM and the like has a lead-in area (LIA) close to the central hole and an outmost lead-out area (LOA). On the program area between the LIA and LOA, data are written in a track type. The data written on the tracks are divided into sectors (12) of 2448 bytes such as Sn, Sn-1, Sn-2, . . . , etc. Each sector (12) is subdivided into a main channel (23) of 2352 bytes and a subcode channel (21) of 96 bytes. In the main channel (23), audio music files are recorded, for example on a CD+G disk. In the subcode channel (21), graphic data files are recorded in a CD+G graphic data format.

The subcode channel (21) consists of four packets (32), (34), (36) and (38) each of 24 bytes, respectively. In each packet, one instruction is recorded. The packets (32), (34), (36) and (38), each consist of command (41) of one byte, instruction (43) of one byte, parity Q (45) of two bytes, operand (47) of 16 bytes, and parity P (49) of four bytes. The command (41) represents whether the current packet has an instruction in the CD+G graphic data format or is empty. Generally, when the value of the command (41) is 0x09, the corresponding packet is considered as an instruction data in the CD+G graphic data format. When the value of the command (41) is not given or negligible, it means that the corresponding packet does not have any graphic data on a CD+G disk. The instruction (43) stores integers representing one of instructions of various types, for example, 'Memory Preset', 'Title Block Normal/Xor', 'Color Table Low/High', 'Scroll Preset/Copy', etc., as will be detailed later with reference to FIG. 6. ParityQ (45) and parityP (49) contain data for parity check. The operand data required for executing any instruction shown in the instruction (43) is stored in the operand (47).

FIG. 2 shows a CD+G graphic data format together with the bit structure of a subcode channel. As shown in this figure, each packet of the subcode channel is divided into the portions called P, Q, R, S, T, U, V and W. The portions P and Q contain control data for controlling CD's, and the remaining portions R to W remain empty on a general audio CD. On a CD+G disk, CD+G graphic data files are stored in the channels R to W as shown in FIG. 2.

However, when extracting files in the aforementioned CD+G graphic data format, the space allocated to one instruction is fixed as it is limited on the subcode channel structure of a CD of only 96 bytes. In addition, channels P and Q do not actually contain any graphic data and as such occupy valuable space. This is partly due to the fact that the subcode channel of a CD was originally intended to record control data of an audio CD and thus not originally intended to store graphic data files.

In a CD+G graphic data format, the data processing rate is limited to the data rate of an audio CD, which is 1×. Therefore, the number of instructions that can be processed per second is restricted, so that the display resolution and screen size of graphic data are restricted. Typically with a 1× data processing rate, the data is read at 75 sectors per second from a CD+G disk. One subcode channel exists in each respective sector, and the subcode data stored in the subcode channel is divided into four packets. Each packet can have one instruction for displaying graphic data. Therefore, it is possible to process up to 75×4=300 instructions in a second. The screen specified by the CD+G format is a rectangular shape of 300×216 pixels, and the tile size that is a basic graphic output unit of a CD+G format is 12×6 pixels. For displaying one tile, one instruction is required. Therefore, for displaying the entire screen, at least 700 tiles, or at least 700 CD+G instructions are required, not counting the border near the screen edge. Consequently, in order to represent the graphic data that occupy the whole screen of 300×216 pixels in the CD+G format, at least 700 instructions must be processed. This processing takes at least two seconds as only 300 instructions can be processed per second Therefore, when displaying graphic data in the CD+G format, even longer processing time is required for representing larger screens or screens of higher resolutions. This makes it almost impossible to improve a screen for displaying words or lyrics of music with subtitles.

Typical karaoke files are integrated into one file. For example, karaoke files into which conventional, e.g., 'midi' files are converted are in the form that the data corresponding to accompaniment music and the data corresponding to the graphic of words are integrated into one file. Accordingly, for such karaoke file format, it is impossible to add words or other description to be displayed into conventional music files, such as music files in which singer's voice is recorded. Furthermore, once a file is created in the above karaoke dedicated file format, there also arises a problem that the lyrics cannot be changed or additional lyrics cannot be added, such as lyrics in additional languages.

SUMMARY OF THE INVENTION

Accordingly, it is an object of the present invention to provide a graphic data file and method for generating the same and apparatus for playing the same which overcomes one or more disadvantages of the prior art.

One aspect of the present invention relates to a graphic data file containing instructions for displaying graphic data on a display device. The graphic file comprises a header, wherein the header identifies a start of the graphic data file; a plurality of portions of instruction data following the header, wherein each portion of instruction data comprises an instruction for controlling the graphic data of a predetermined size to be displayed on the display device, and frame information to determine an order and a period of time for displaying the graphic data at the predetermined size; and a tail, wherein the tail contains information for identifying the end of the graphics data file.

Another aspect of the present invention is a method is provided for generating independent graphic data files containing instructions for controlling a process for graphic data to be displayed on a display device. The method comprises the act of: generating a header containing information for identifying a start of the graphic data file; generating a plurality of portions of instruction data following the header, wherein each portion of instruction data comprises an instruction for controlling the graphic data of a predetermined size to be displayed on the display device, and frame information to determine an order and a period of time for displaying the graphic data of the predetermined size; and generating a tail following the plurality of portions of instruction data, wherein the tail contains information for identifying an end of the graphic data file.

Another aspect of the present invention relates to an apparatus for playing a graphic file. The apparatus comprises: a storage medium containing at least one graphic data file generated according to the present invention; a processor for reading and processing instructions contained in a file on the storage medium; and an output device for outputting the files processed by the processor, wherein the output device comprises a first output device for outputting graphic information associated with the graphic data file.

Still other objects, advantages and novel features of the present invention will become apparent to those skilled in the art from the following detailed description which is simply by way of illustration various modes contemplated for carrying out the invention. As will be realized, the invention is capable of the other different aspects, all without departing from the invention. Accordingly, the drawings and description are illustrative in nature and not restrictive.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

FIG. 4 shows a table for illustrating types of exemplary instructions contained in the MCG graphic data files generated according to one embodiment of the present invention;

DETAILED DESCRIPTION OF THE INVENTION

Reference will now be made in detail to various embodiments of the invention, examples of which are illustrated in the accompanying drawings, wherein like numerals indicate similar elements throughout the views.

Figure 3:
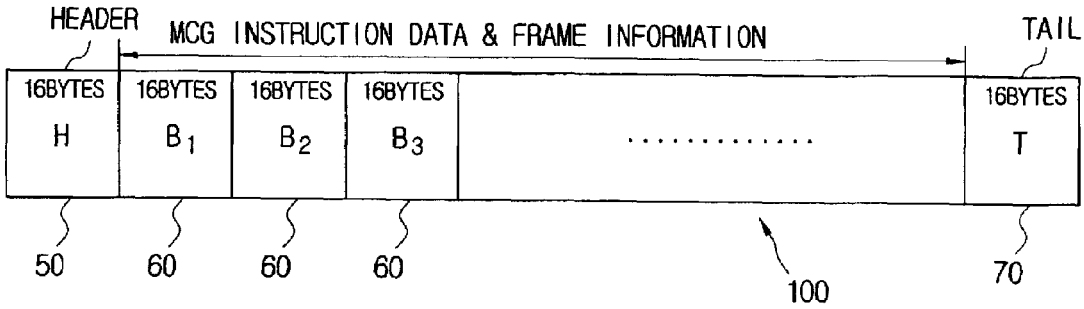
FIG. 3 shows schematically an exemplary structure of an MCG graphic data file structure generated according to one embodiment of the present invention.
Figure 10:
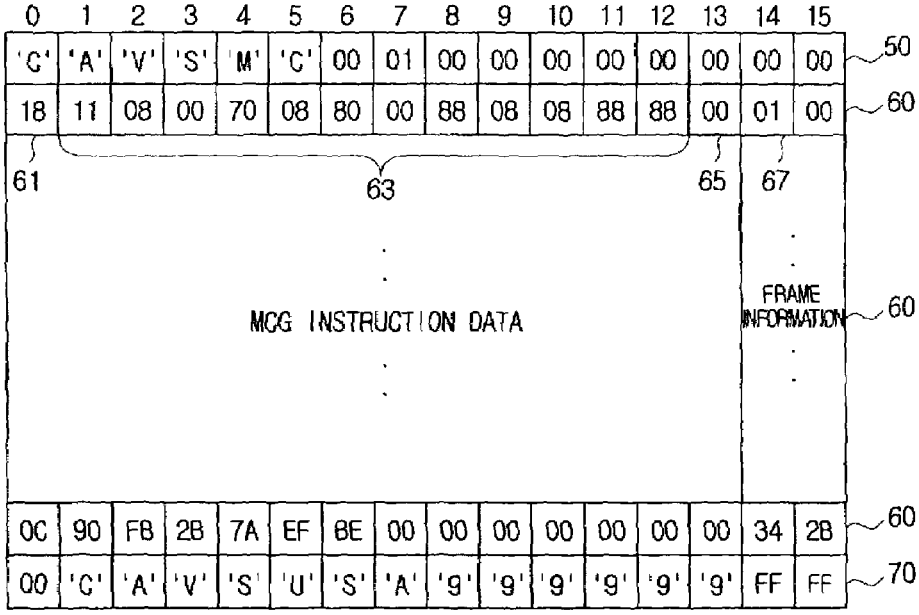
FIG. 10 shows schematically an exemplary file structure of FIG. 3 on the byte basis.

FIGS. 3 and 10 show an overall structure of an independent graphic data file (100) format proposed according to the invention. The invention pertains to a method for generating and playing graphic data files in the format shown in FIG. 3 and to a recording medium in which the files are recorded. In order to differentiate the files of the present invention from the prior art graphic data files, the graphic data file proposed according to the invention is referred to as a 'multimedia compact graphics file (MCG file)' or 'super compact disc graphics file (SCDG)'.

According to one embodiment of the present invention, a graphic data file (100) containing instructions for displaying graphic data on a display device is provided. The graphic data file (100) comprises a header (50), wherein the header identifies a start of the graphic data file; a plurality of portions of instruction data (60) following the header, wherein each portion of instruction data (60) comprises an instruction for controlling the graphic data of a predetermined size to be displayed on the display device, and frame information to determine an order and a period of time for displaying the graphic data at the predetermined size; and a tail (70), wherein the tail (70) contains information for identifying the end of the graphics data file.

According to another embodiment of the present invention, a method is provided for generating an independent graphic data file (100) containing instructions to control the process for the graphic data containing characters to be displayed on a display device such as a TV or monitor. The method for generating the MCG graphic data file (100) according to the invention comprises the steps of generating a header (50), generating a plurality of instruction data (60), and generating a tail (70). The header (50) and the tail (70) indicate the start and the end of the file (100), respectively. The instruction data (60) contains an instruction for displaying the graphic data by its execution and a frame information for determining an order and a period of time for executing the instruction.

In one embodiment, the header (50) may contain the information for identifying the start of the MCG graphic data file, for example, for identifying character strings and versions. In one embodiment, 16 bytes are allocated to the header (50) as depicted in the embodiments of FIGS. 3 and 10. The tail (70) is allocated 16 bytes and contains the information for identifying the end of the MCG file. In the tail (70), a predetermined code for identifying the end of the instruction data of the MCG file, e.g., a character string such as 'CAVSMC' can be recorded. In a further embodiment, the value to be recorded in the portion corresponding to the frame information is 0xFFFF, the maximum value that can be included, since the space for the frame information is 2 bytes. In this case, all values starting from 0x0000 except 0xFFFF can be used for the frame information.

In one embodiment, each portion of the instruction data (60) generated following the header (50) is allocated 16 bytes, respectively, and each comprises, a portion (61) allocated 1 byte for indicating the instruction type, an operand (63) which is allocated a maximum of 12 bytes for executing the instruction and one instruction (65) allocated the remaining space of the 16 bytes. By executing this instruction, graphic data of a predetermined size can be displayed in the display device. For example, in a karaoke file, words can be displayed on a screen by executing the instruction.

Figure 1:
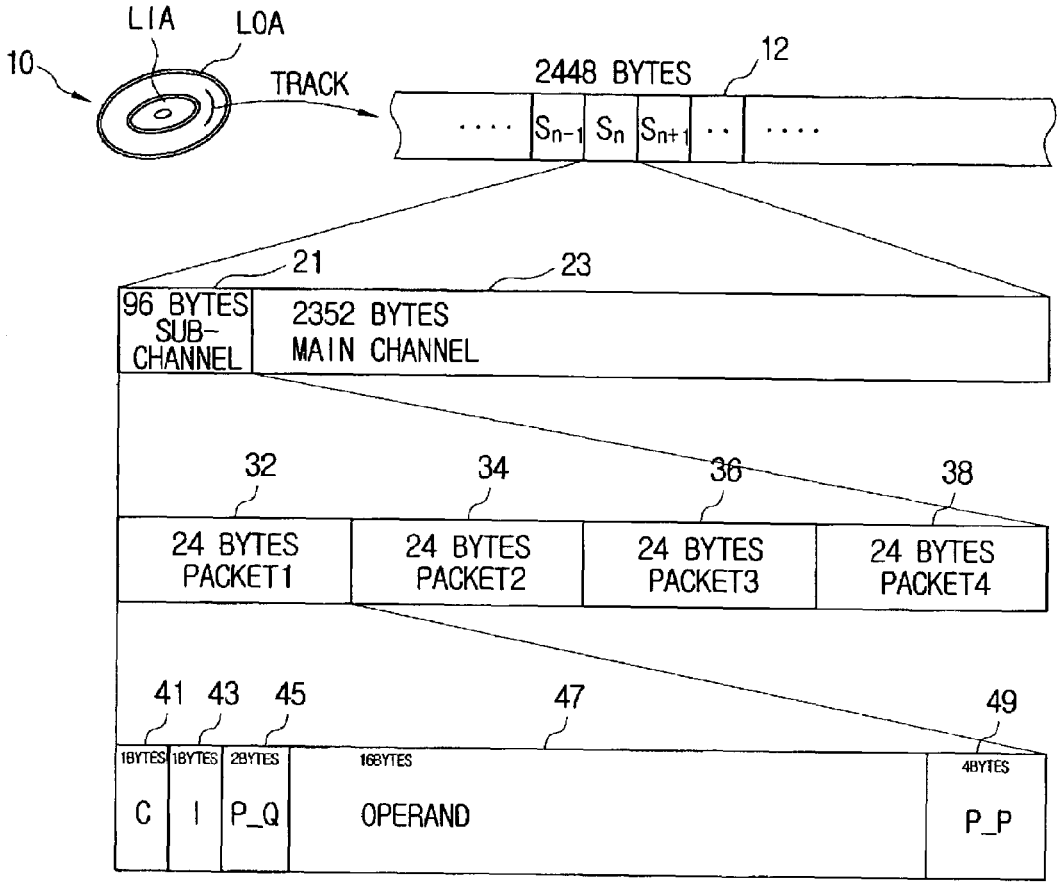
FIG. 1 shows schematically a data configuration of a conventional CD+G disk for karaoke.
Figure 2:
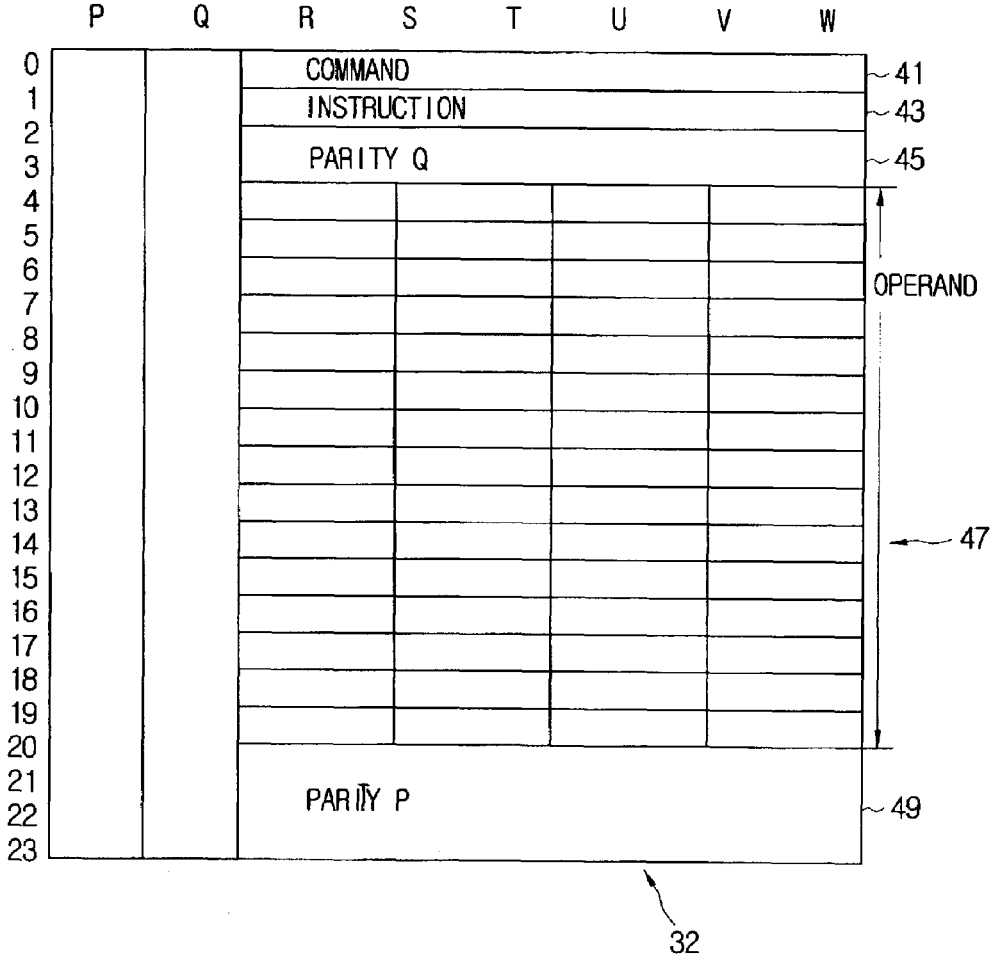
FIG. 2 shows schematically a bit structure of a packet in which one subcode graphic instruction is stored, in the data configuration of FIG. 1.

In one embodiment, the instruction data (60) further comprise frame information (67) for determining which instruction among the plurality of instruction data will be executed, in which order and how long the instruction data will be executed. The frame information may be an integer of, e.g., 2 bytes, and indicates the time frame to which the corresponding instruction data belongs. According to one embodiment of the present invention, the frame information may represent a period of time equal to the sectors (12) (see FIG. 1) in the CD+G format. In this case, one frame can be represented as the period of time of 1/75 second, corresponding to the data rate in which 75 sectors per second can be processed. In this embodiment, it is an advantage that it is easy to extract a graphic data file from a conventional CD+G disk and then to convert it into an MCG graphic data file according to the invention. However, it is not necessary that the frame information herein must be configured to correspond to the sectors of the CD+G format.

In one embodiment of the present invention, each frame information is represented as a stream that starts from 0x0000 and continuously increases. In this case, all of the instruction data having the frame information of the same value are processed simultaneously. The number of instruction data having the frame information of the same value is fixed, for example, to 4 in the conventional CD+G format. In a further embodiment of the present invention, the maximum predetermined number of instructions in the plurality of portions of the instructions data having the same frame information is an integer multiple of 4. The number of the instruction data is interrelated with the size of a screen. In the CD+G format having the fixed number of instruction data, the screen size is also fixed. On the contrary, no restriction is imposed on the screen size in a file in the MCG format according to the invention. Since the MCG format is independent of the physical structure of a medium in which a file is recorded, the number of instruction data having the frame information of the same value may be 4, 16, or more. Accordingly, the number of instructions that can be processed in a second can significantly increase.

For example, when the number of instruction data with the frame information of the same value is four, the number of instructions that can be processed in a second is 75×4=300, equal to that in the conventional CD+G format. When the number of instruction data with the frame information of the same value is 16, the number of instructions that can be processed in one second is 75×16=1200. By adjusting the number of instruction data with the same frame information as such, the invention has an advantage that it is possible to implement screens of various sizes in comparison with the conventional manner.

FIG. 4 illustrates exemplary instruction types and values of the types that can be stored in the portion (61) for indicating an instruction type in an MCG graphic data file according to the invention. These are similar to the instruction types used in the conventional CD+G graphic data format. The data structure of each instruction illustrated in FIG. 4 is more detailed in FIGS. 5 to 10.

Figure 5:
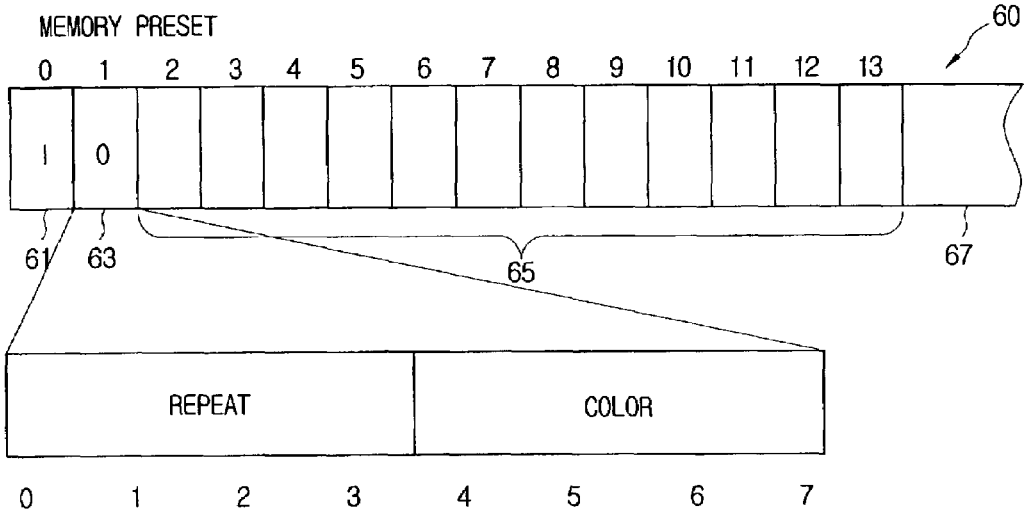
FIGS. 5 to 9 show schematically exemplary bit structures of each instruction shown in the table of FIG. 4, before encoding.

The 'Memory Preset' of the structure as illustrated in FIG. 5 is for fully clearing a screen with a specified color. In order not to fail to fully clear the screen, the same instruction can be repeated, the number of repetition times is specified to indicate the order of the repeated instructions. FIG. 5 illustrates that, in the 'Memory Preset' instruction, four bits of the operand (63) of one byte are used to store a value of 'repetition times', and the remaining four bits are used to store the value for specifying the value of the 'color' to be painted on the screen. The value that can be stored for the 'repetition times' may range, e.g., from 0x00(0) to 0xff(15). The instruction with the value of 0x00 is first executed. 'Memory Preset' is one instruction but has to carry out many tasks actually, so that it gives a lot of load to a system. In case of a karaoke machine whose performance is limited, it is required to invoke the instruction several times repeatedly to fully clear the screen against errors. However, in a system such as a PC with enough performance and in which relatively exact input/output, e.g., data integrity and so on is guaranteed, it is satisfactory to invoke the instruction only once. Therefore, it will be enough to include only the Memory Preset instruction with the value of '0' for the 'repetition times'. In the portion (61) for indicating the instruction type, an integer '0x0' for indicating the 'Memory Preset' instruction is stored as shown in FIG. 4.

Figure 6:
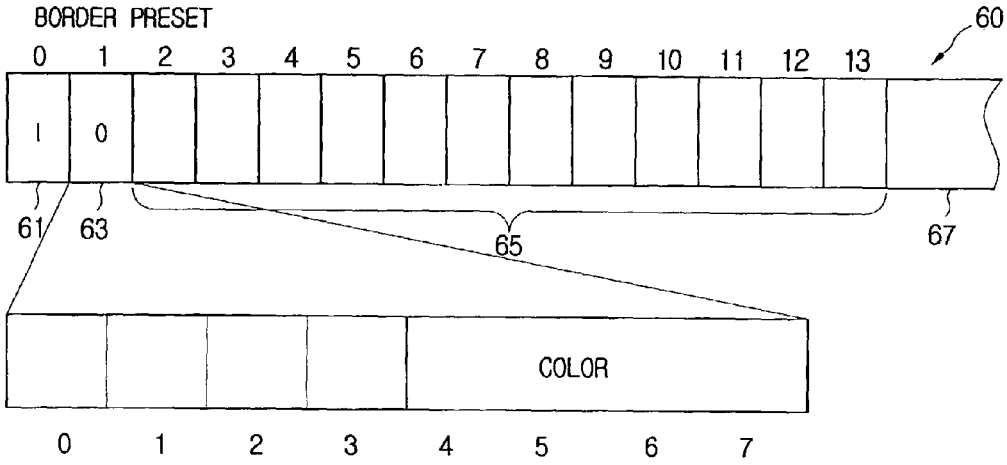

Similarly, 'Border Preset', the instruction for painting the border of a screen with a given color, has a structure shown in FIG. 6. The integer 0x1 for indicating a corresponding instruction is stored in the portion (61) for indicating the instruction type. Since it is not required to paint the border repeatedly, only the value of 4 bits for indicating a given color is stored in the operand (63). The screen border is specified as a secure area, in which actual graphic data are not displayed.

Figure 7:
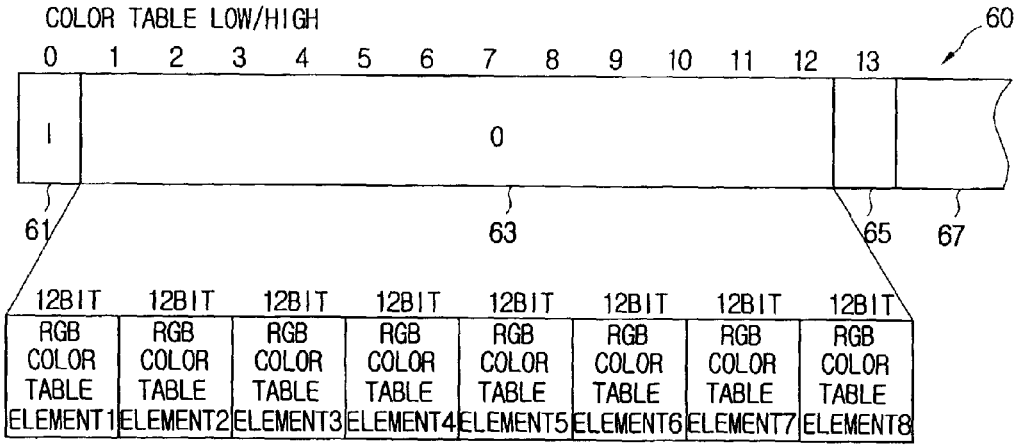

The instruction 'Color Table High/Low' for loading eight upper/lower elements of the RGB color table, respectively, has a structure as shown in FIG. 7. The integer 0x2/0x3 for indicating a corresponding instruction is stored in the portion (61) for indicating the instruction type. The operand (63) is of 12 bytes because 12 bits are allocated, respectively, to each of the eight upper/lower elements in the RGB color table. One element in the RGB color table requires a total of 12 bits, consisting of 4 bits for R, 4 bits for G and 4 bits for B. Therefore, when there are 16 elements in a RGB color table, 12 bits×16=24 bytes are required. Accordingly, since it is possible to allocate 12 bytes to one instruction in the MCG graphic data format according to the invention, it is possible to load all elements on the RGB color table only when two instructions are used.

Figure 8:
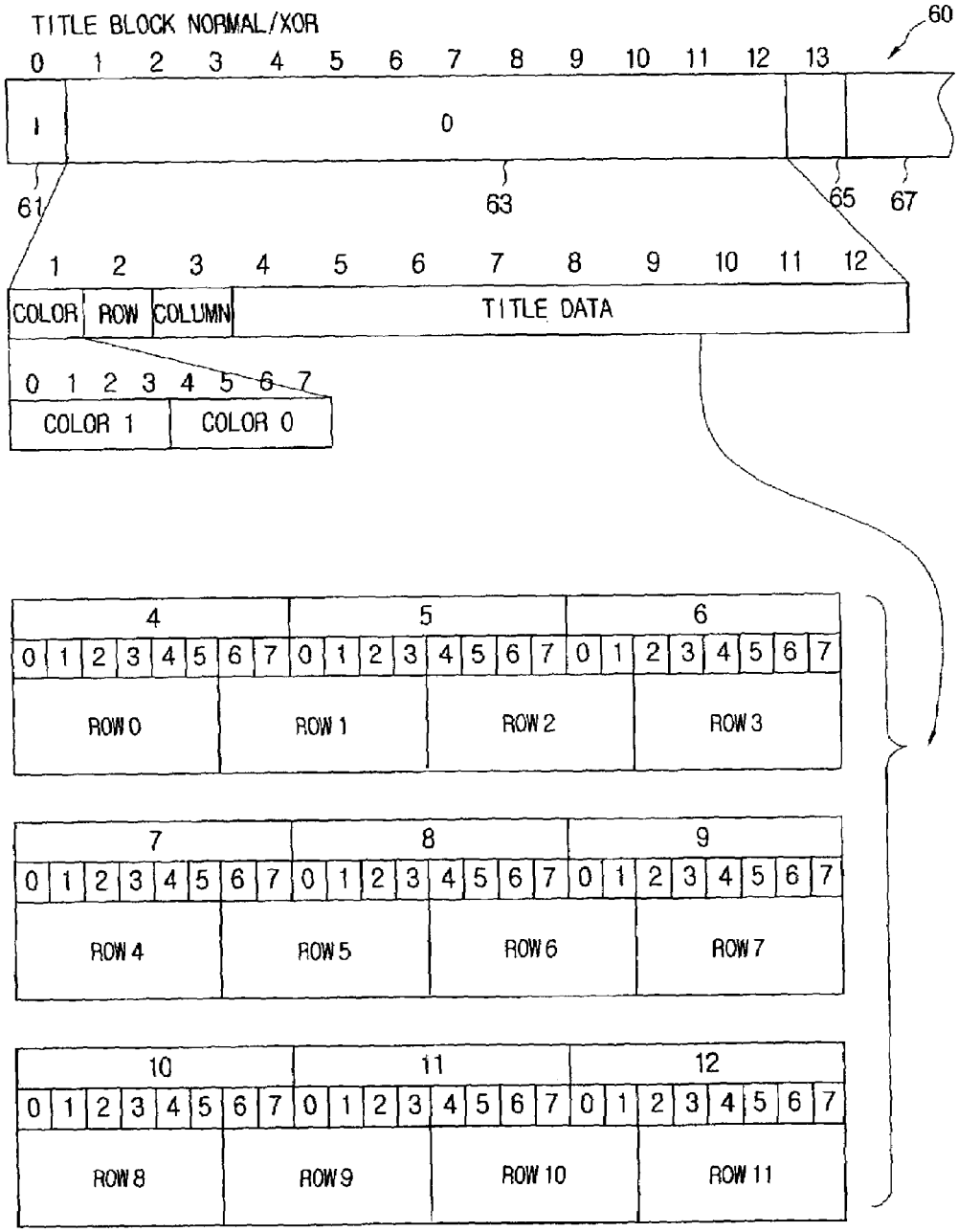

'Tile Block Normal/Xor' for outputting a two-color bitmap tile (for example, character font) of 12×6 pixels as Normal/Xor has a structure as shown in FIG. 8. This instruction is used to display tiles, the smallest unit of actually meaningful graphic data, on a specified location of a screen. As shown in FIG. 8, the integer 0x4/0x5 for indicating a corresponding instruction is stored in the portion (61) for indicating an instruction type. The operand (63) comprises a portion for specifying two colors, a portion for indicating a row and a column on a specified location and a portion for indicating the data for the tiles to be displayed. The color specified at the first one byte of the operand (63) consists of 4 bits in the first half for specifying the color of the corresponding pixel when the tile data has the value of '1' and 4 bits in the second half for specifying the color of the corresponding pixel when the tile data has the value of '0'. The subsequent two bytes consist of the value for specifying the row and the column at the location where the tile is displayed. If the value is multiplied by the pixel size (12×6) of the tile, the result indicates the location where the tile is actually displayed on the screen. For example, in an embodiment for a display screen of the size of 300×216, one byte for indicating a row ranges from 1 to 16, and one byte for indicating a column ranges from 1 to 48. Alternatively, in another embodiment for a display screen of the size of 600×432, one byte for indicating a row ranges from 1 to 32, and one byte for indicating a column ranges from 1 to 96.

Figure 9:
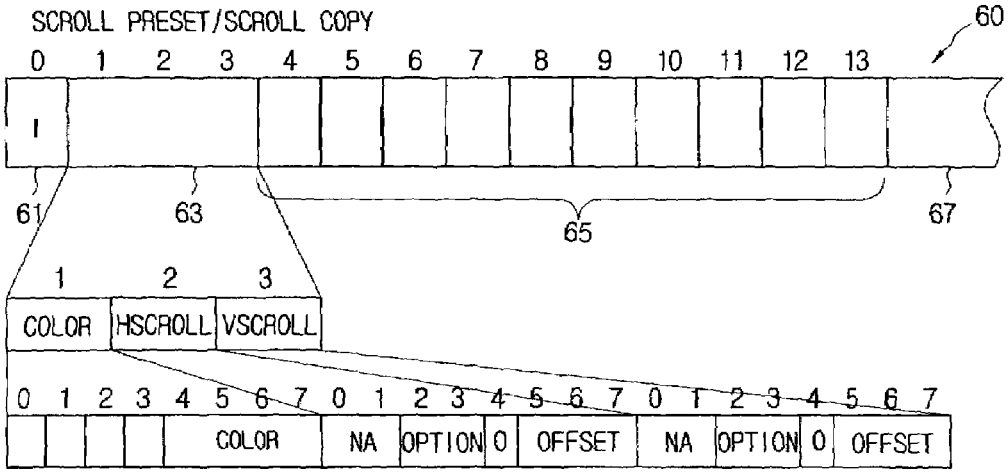

Finally, 'Scroll Preset/Copy', the instruction for screen scrolling, has a structure shown in FIG. 9. This instruction can be used to paint the remaining space with a given color (scroll-preset) or to copy the same pixel as the moved pixel and then to paste the pixel to the space (scroll copy), for example, after moving one tile, that is graphic data, horizontally or vertically. The integer 0x6/0x7 for indicating a corresponding instruction is stored in the portion (61) for indicating the instruction type. The operand (63) allocates one byte in order to specify color (or to specify a copied pixel), one byte in order to specify horizontal scroll, and one byte in order to specify vertical scroll. Each portion for specifying horizontal and vertical scrolls comprises the option bit portion having '1'/'2' for indicating right/left or up/down scrolling and '0' for indicating no scrolling, and the offset bit portion for specifying offset for graphic display, and further comprises null ('0') of one bit and unavailable bit NA of 2 bits interposed between the above two portions in order to separate the portions. When the option of the scroll specifying portion is '1'/'2', it means to scroll 6 pixels to the right/left in horizontal scrolling, and 12 pixels upward/downward in vertical scrolling. The offset range of horizontal scrolling is 0 to 5 pixels and that of vertical scrolling is 0 to 11 pixels.

An exemplary MCG graphic data file format according to one embodiment of the present invention as described above has a structure as illustrated in FIG. 10. For the MCG graphic data file generated according to the method for generating a file of the invention, there may be a first embodiment where the display screen size is 300×216 and a second embodiment where the screen size is 600×432 as detailed above. The two embodiments have each different version information indicated in the header (50) described above, different frame information (67) and different instruction data structure for 'Tile Block Normal/Xor' in actual data, and the remaining portions are the same. That is, the number of instructions having the same frame information in the frame information (67) is 4 in the first embodiment, but 16 in the second embodiment. In the operand of 'Tile Block Normal/Xor', the ranges of the values for indicating rows and columns are different depending on the screen size, as described.

One skilled in the art will appreciate that the graphic data file according to the present invention is not limited to the above first and the second embodiments. That is, for example, alternative embodiments include for small screens such as a display for a small cell phone or for large screens such as large stages or large signboards with lamps by properly modifying the frame information and 'Tile Block Normal/Xor' at discretion. If required, instructions of different types other than those described, can also be added.

Figure 11:
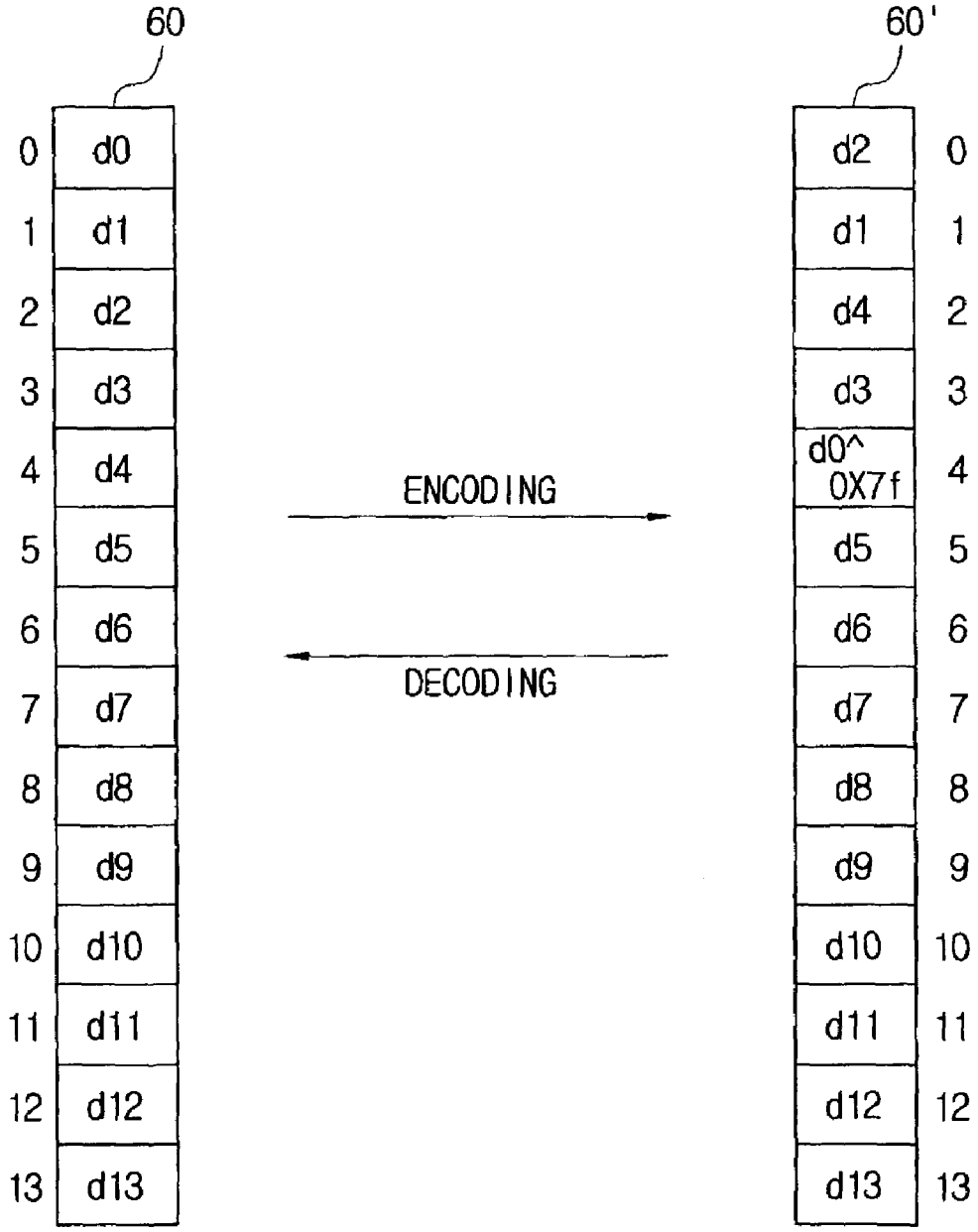
FIG. 11 shows schematically an example for encoding/decoding each instruction of FIG. 4 according to one embodiment of the present invention.

According to another embodiment of the present invention, it is possible to generate a file in the MCG graphic data file format as described and then to save it as a final file after encoding it as illustrated in FIG. 11 in order to prevent illegal use of the file by, e.g., hacking. The illustrated example shows only the instruction portion of 14 bytes in one instruction data (60) for the sake of simplicity. The portion 'd0' is a portion (61) for specifying the instruction type, and the portions 'd1' to 'd13' correspond to the operand (63) and the extra portion (65). The file consisting of such encoded instructions (60') can be decoded to be executed through a reverse decoding process when played. FIG. 11 does not illustrate the encoding process of the frame information (67), but it is preferable to apply the encoding process to the frame information together with or separately from the instruction. Any encoding/encryption process known to one skilled in the art may be utilized.

The MCG graphic data file generated according to the present invention can be separated from a music file for accompaniments of which separation is difficult conventionally. It is a great characteristic that the MCG file according to the present invention is in an independent file format that can be separately handled, as described above. It is not necessary for the MCG file according to the present invention to be stored in a particular location such as a subcode channel as in a conventional CD+G disk, and the MCG file can be handled like a general file. Therefore, the invention is characterized in that users can easily build up a database using a general apparatus such as PCs.

The MCG file according to the invention can be used to display words of a song by playing the MCG file along with music files for accompaniments used in a karaoke parlor, wherein, since frame information, which is time information, is contained in the MCG file, a special synchronization work with respect to the music file for accompaniments is not needed. Owing to such characteristics, a system can be conceived which can be used for graphic files for words of music additionally played along with a music file for accompaniments and which also can be played with conventional music files for appreciation, so that users can read words of the music and sing to the music while listening to his favorite singer's voice.

One of various applications of the MCG file according to the present invention can be implemented as, e.g., in language learning apparatuses for playing the MCG files for displaying characters and playing audio/video files simultaneously. The MCG file has no restrictions such as data processing rate as in a CD+G file, so that users can adjust freely the screen size, resolution, etc. at their discretion.

The method for generating a file according to the present invention can be used when creating an MCG graphic data file for the first time using any data. Alternatively, it is possible to extract graphic data file information from the CD+G graphic file format present in a subcode channel of a conventional CD+G disk and then to convert the information into the MCG file format to generate an MCG graphic data file. Since the instruction data contained in the MCG file format is substantially similar to the instruction and the operand used in the CD+G file format, it is possible to extract graphic data from the CD+G disk and then to easily convert the data into an MCG file. In this case, along with the extraction of the graphic data for displaying words from a CD+G disk and the generation of an MCG file, the music for accompaniments used in a karaoke parlor, stored on audio tracks of the CD+G disk, can also be extracted and compressed into a popular sound format of good compression rate such as, e.g., MP3 or OGG.

Figure 12:
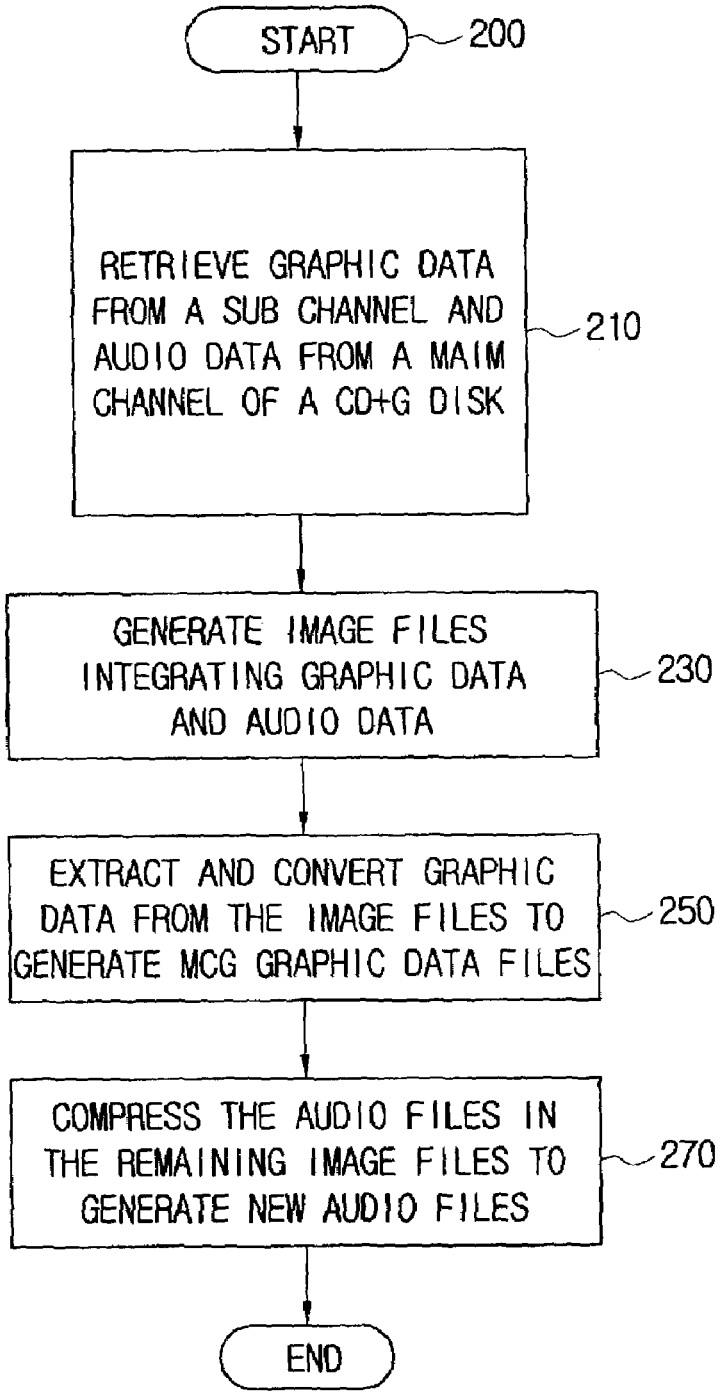
FIG. 12 shows schematically a flow chart a method of generating graphic data files according to one embodiment of the present invention.

FIG. 12 illustrates schematically a flow chart for describing the steps of extracting files from a CD+G disk. Starting at step 200, graphic data are retrieved and extracted from the subcode channel of the CD+G disk, and audio data are retrieved and extracted from a main channel at step 210. The extracted data are stored temporarily in respective memories such as buffers. At step 230, the graphic data and the audio data stored, respectively, in buffers are integrated to generate, e.g., one image file (.bin). Subsequently, at step 250, only the graphic data are extracted from the one image file and then converted into a file in the MCG graphic data format in the first embodiment or the second embodiment with reference to FIGS. 3 to 11. Then at step 270, only the audio file in the image file is separately compressed to generate an audio file in, for example, the MP3 format.

In this case, the MCG graphic data file format generated according to the first embodiment, is similar to the CD+G graphic data file format in terms of the display screen size, the number of instructions processed in one second, etc. Therefore, the process of conversion into an MCG file according to the first embodiment is completed by compressing and re-arranging the space for the P and Q channels in the CD+G graphic data file or for other parity information, and adding the frame information corresponding to each sector.

The MCG graphic data file generated according to the second embodiment, however, was developed not to convert a CD+G graphic data file but to increase the screen size and resolution separately, and thus the MCG graphic data file does not always correspond to the CD+G file. That is, in the second embodiment, the display screen size is four times larger than that by a CD+G graphic data file and the number of instructions to be processed in one second increases by four times. It is also possible to convert a CD+G graphic data file into an MCG graphic data file according to the second embodiment. However, in this case, one instruction for representing one tile in the CD+G graphic data file will be converted into four instructions to be displayed in the form of four tiles arranged quadrangularly, that is in the form of 2×2 in the second embodiment of the invention. In this way, a CD+G graphic data file may be converted into an MCG graphic data file according to the second embodiment of the invention.

In order to extract a graphic data file from a CD+G disk through the steps described above, a CD-RW drive that allows access to a subcode channel of a CD+G disk or a device that can read the subcode channel data, and a system in which software that implements the method for generating the MCG files according to the invention can be installed and executed. For example, a personal computer system with a CD-RW drive can easily extract and generate graphic files from a CD+G disk, using software that implements the extraction and conversion of a graphic data file from a CD+G disk into an MCG file according to the invention, as described above.

Figure 13:
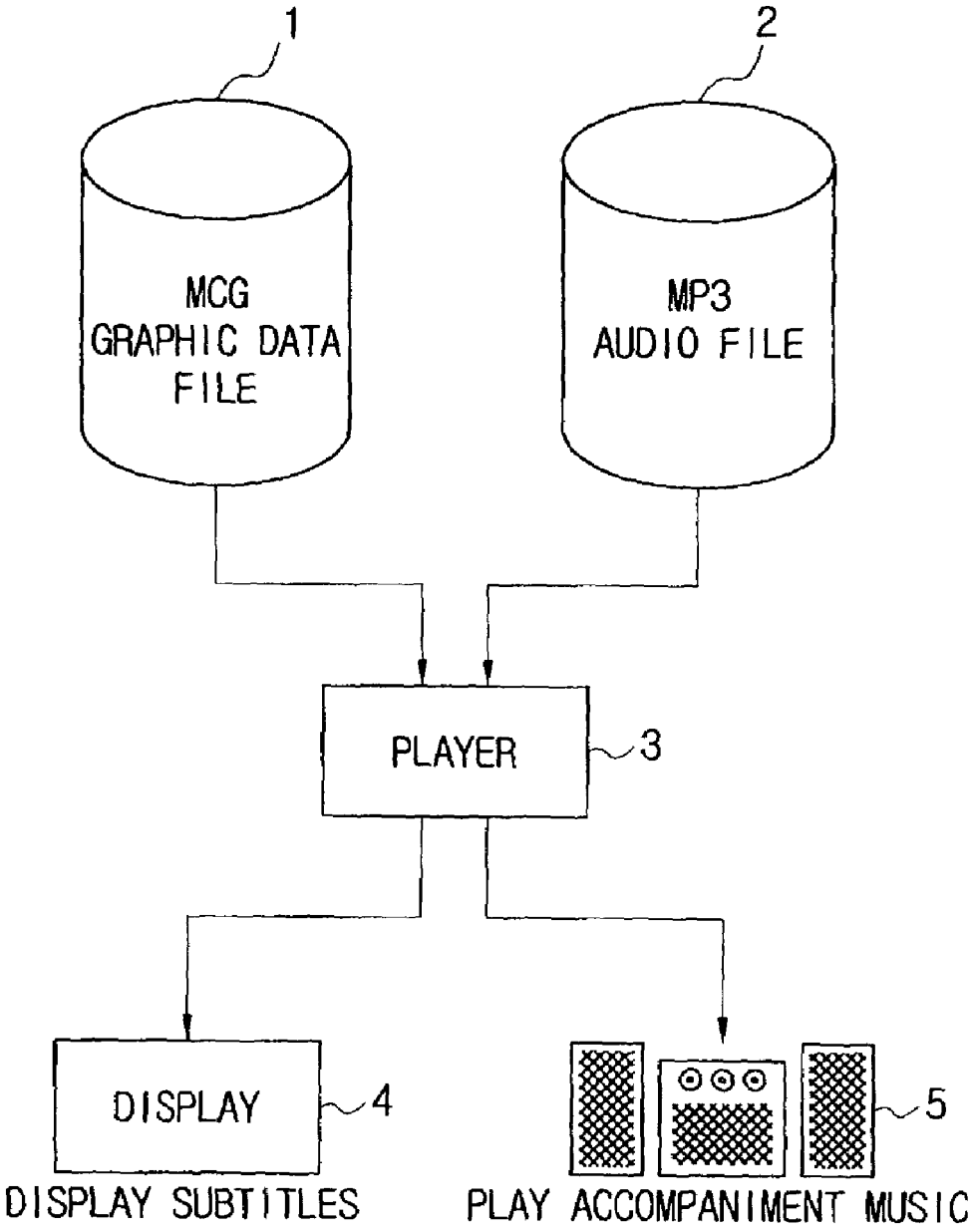
FIG. 13 shows schematically an exemplary system for playing MCG graphic data files encoded according to one embodiment of the present invention.

FIG. 13, according to one aspect of the present invention, illustrates schematically a system for playing a graphic data file according to the invention. The player system comprises a database (1) having MCG files in the MCG graphic data file format as described above; a database (2) having music files for accompaniments used in a karaoke parlor, e.g., in the MP3 format; a player (3) for processing and outputting data from the two databases (1) and (2), respectively; a display (4) for receiving and usually visually displaying output signals from the player (3); and a speaker system (5) for audibly replaying the output signal.

In this case, the two databases (1) and (2) may be pre-stored in a recording medium such as a hard disk of a PC or a CD-ROM disk for generally storing data. The player (3) may comprise a program dedicated to playing the MCG graphic data files to be executed by a system such as a PC. The program dedicated to playing the MCG graphic data files may be configured not only to display the MCG graphic data but also to play music files for accompaniments used in a karaoke parlor or other types of video/audio data. Alternatively, the player (3) may be implemented as one or more functions added to a conventional apparatus for accompaniments for a karaoke parlor, or implemented as independent dedicated software or additional plug-in software.

According to another embodiment of the present invention, a recording medium such as a DVD disk can be used to store the two databases (1) and (2). In this case, the player (3) may be a DVD player that can play MCG graphic data files. In the DVD disk, the MCG files generated to display words and the MP3 files generated to play accompaniment music can be stored.

The display (4) is preferably a display device such as a TV or a monitor. However, the MCG graphic data file format according to the invention allows the screen size to be freely selected. This is because the tile size which is a display unit of graphic data can be set larger or smaller, other than the normal size of 12×6. Therefore, the display (4) of the present player system may be used in portable apparatuses with a small screen or large electric signboards.

As described above, the invention has a significant effect to solve the problems of the conventional CD+G disks and graphic data file format for karaoke music, and proposes a novel graphic data file format with many advantages.

In one embodiment of the present invention, the file generated according to the invention contains only essential data for graphic display and results in storage space reduction. The file also has a significant advantage in that since the data processing rate per second can be set at discretion, the screen size and resolution can be specified as desired.

The invention also provides a method for playing files so that the graphic file of the invention can be played along with an audio file extracted from a CD+G disk and compressed into, e.g., MP3 format, and a medium on which the file is stored. The method for playing files and the medium according to the invention have an advantage that more than 100 music files and graphic files can be stored on one CD and played, in comparison with a conventional CD that can store approximately 10 to 20 music files on a CD.

Since the graphic data file according to the invention is not stored in a subcode channel of a CD but handled as a typical general file, the file can advantageously be stored on a large storage disk such as a hard disk of a PC to easily build up a large database.

Since the graphic data file according to the invention is an independent file of a music file for accompaniments, it is easy to modify the inventive graphic data file to a file with different contents, while not adversely affecting the music file. Accordingly, it is possible to add or exclude music words or lyrics in, e.g., English, Japanese, Korean, etc., other information such as singers or composers. Also, the invention can be widely used for generating a graphic data file for displaying music words or other related information in a conventional audio music file including singer's voice.

In summary, numerous benefits have been described with results implying the concepts of the invention. The foregoing description of the exemplary embodiments has been prepared for the purpose of illustration and description. It is not intended to be exhaustive or to limit the invention to the precise form disclosed. Many alternatives, modifications and variations will be apparent to those skilled in the art of the above teaching. Accordingly, the invention is intended to embrace all alternative, modifications and variations that have been discussed herein, and others that fall within the spirit and broad scope of the claims.

We claim:

1. A graphic data file containing instructions for displaying graphic data on a display device, comprising:

a header, wherein the header identifies a start of the graphic data file;

a plurality of portions of instruction data following the header;

wherein each portion of instruction data comprises an instruction for controlling the graphic data of a predetermined size to be displayed on the display device;

wherein each portion of instruction data comprises 16 bytes and wherein each 16 byte portion comprises 1 byte allocated for designation of instruction type, 12 bytes allocated for an operand for executing an instruction and three bytes allocated to an instruction;

wherein the instruction data comprises frame information for determining which of the plurality of portions of instruction data shall be executed and in what order and length each portion of the instruction data will be executed; and a tail, wherein the tail contains information for identifying the end of the graphics data file; and wherein the graphic data file is not stored in a channel of an audio file or a storage medium.

2. The graphic data file of claim 1, wherein a predetermined number of instructions in the plurality of portions of instruction data have the same frame information and will be executed simultaneously.

3. The graphic data file of claim 1, wherein the plurality of portions of instruction data are encrypted.

4. The graphic data file of claim 2, wherein the plurality of portions of instruction data having the same frame information comprises a quantity of portions equal to an integer multiple of 4.

5. The graphic data file of claim 1, wherein the header, each portion of instruction data, and the tail each comprise 16 bytes.

6. A method for generating an independent graphic data file containing instructions for controlling a process for graphic data to be displayed on a display device, comprising the act of:

generating a header containing information for identifying a start of the graphic data file;

generating a plurality of portions of instruction data following the header, wherein each portion of instruction data comprises an instruction for controlling the graphic data of a predetermined size to be displayed on the display device;

wherein each portion of instruction data comprises 16 bytes and wherein each 16 byte portion comprises 1 byte allocated for designation of instruction type, 12 bytes allocated for an operand for executing an instruction and three bytes allocated to an instruction;

wherein the instruction data comprises frame information for determining which of the plurality of portions of instruction data shall be executed and in what order and length each portion of the instruction data will be executed; and generating a tail following the plurality of portions of instruction data, wherein the tail contains information for identifying an end of the graphic data file.

7. The method of claim 6, wherein a predetermined number of instructions in the plurality of portions of instruction data have the same frame information.

8. The method of claim 6, further comprising the act of encrypting the plurality of portions of generated instruction data.

9. The method of claim 7, wherein the plurality of portions of instruction data having the same frame information comprises a quantity of portions equal to an integer multiple of 4.

10. The method of claim 7, wherein the instructions in the plurality of portions of instruction data having the same frame information are processed simultaneously for a predetermined amount of time.

11. The method of claim 6, wherein the header, each portion of the instruction data, and the tail are of an identical predetermined size.

12. The method of claim 6, wherein the act of generating the plurality of portions of instruction data further comprises the act of extracting instruction data contained in a CD+G graphic file from a subcode channel of a CD+G storage medium.

13. The method of claim 6, further comprising the act of storing the generated graphic data file to a computer-readable storage medium, wherein the graphic data file is not stored in a channel of an audio file.

14. A computer-readable storage medium comprising at least one graphic data file of claim 1.

15. A computer-readable storage medium comprising at least one graphic data file generated according to the method of claim 6.

16. The computer-readable storage medium of claim 14, further comprising at least one media file containing information selected from the group consisting of: video data, audio data and video/audio data.

17. The computer-readable storage medium of claim 16, wherein the graphic data file comprises graphic data configured for displaying lyrics of music for karaoke.

18. An apparatus for playing a graphic file, comprising:

a storage medium containing at least one graphic data file generated according to the method of claim 6;

a processor for reading and processing instructions contained in a file on the storage medium; and an output device for outputting the files processed by the processor, wherein the output device comprises a first output device for outputting graphic information associated with the graphic data file.

19. The apparatus of claim 18, wherein the storage medium further comprises at least one media file containing information selected from the group consisting of: video data, audio data and video/audio data, wherein the media file and corresponding graphic data file are configured to be simultaneously processed and output on a predetermined output device; and further wherein the output device comprises a first output device for outputting graphic information associated with the graphic data file and a second output device for outputting media information associated with the media file.

20. The apparatus of claim 19, wherein the graphic data file comprises graphic data for displaying lyrics of music, and the media file comprises audio data of accompanying music for karaoke.

21. A computer program code product for generating an independent graphic data file containing instructions for controlling a process for graphic data to be displayed on a display device, comprising:

a computer-readable program code for causing a computer to generate a header containing information for identifying a start of the graphic data file;

a computer-readable program code for causing a computer to generate a plurality of portions of instruction data following the header, wherein each portion of instruction data comprises an instruction for controlling the graphic data of a predetermined size to be displayed on the display device;

wherein each portion of instruction data comprises 16 bytes and wherein each 16 byte portion comprises 1 byte allocated for designation of instruction type, 12 bytes allocated for an operand for executing an instruction and three bytes allocated to an instruction;

wherein the instruction data comprises frame information for determining which of the plurality of portions of instruction data shall be executed and in what order and length each portion of the instruction data will be executed; and a computer-readable program code for causing a computer to generate a tail following the plurality of portions of instruction data, wherein the tail contains information for identifying an end of the graphic data file.

22. The graphic data file of claim 1, wherein the graphic data file comprises graphic data configured for displaying lyrics of music for karaoke.

* * * * *